US007803094B1

(12) United States Patent
Bolick, Jr. et al.

(10) Patent No.: US 7,803,094 B1
(45) Date of Patent: Sep. 28, 2010

(54) SEATING DEVICE HAVING EXERCISE FUNCTIONALITY

(75) Inventors: Charles H. Bolick, Jr., Conover, NC (US); C. David Bolick, Hickory, NC (US); Timothy Ray Bolick, Hickory, NC (US)

(73) Assignee: Charles H. Bolick, Conover, CT (US)

( * ) Notice: Subject to any disclaimer, the term of this patent is extended or adjusted under 35 U.S.C. 154(b) by 0 days.

(21) Appl. No.: 11/777,605

(22) Filed: Jul. 13, 2007

Related U.S. Application Data

(60) Provisional application No. 60/807,274, filed on Jul. 13, 2006.

(51) Int. Cl.
*A63B 21/04* (2006.01)
*A63B 21/062* (2006.01)

(52) U.S. Cl. ..... 482/130; 482/102; 482/123

(58) Field of Classification Search ..... 482/130, 482/102, 103, 123
See application file for complete search history.

(56) References Cited

U.S. PATENT DOCUMENTS 1,973,945 A * 9/1934 Chavin et al. ..... 482/130
1,994,593 A * 3/1935 Schmidt ..... 482/72
3,636,946 A * 1/1972 Hardy ..... 601/28
3,738,649 A * 6/1973 Miller ..... 482/57
3,955,342 A * 5/1976 Johnson et al. ..... 53/377.2
4,913,423 A * 4/1990 Farran et al. ..... 482/130
4,921,247 A * 5/1990 Sterling ..... 482/138
5,090,694 A * 2/1992 Pauls et al. ..... 482/118
5,234,394 A * 8/1993 Wilkinson ..... 482/92
5,261,864 A * 11/1993 Fitzpatrick ..... 482/52
5,324,243 A * 6/1994 Wilkinson ..... 482/92
5,470,298 A * 11/1995 Curtis ..... 482/130
5,569,138 A * 10/1996 Wang et al. ..... 482/130
5,605,526 A 2/1997 Hatfield
5,658,222 A * 8/1997 Brown ..... 482/52
5,669,864 A * 9/1997 Brister ..... 482/132
5,690,596 A * 11/1997 Parker ..... 482/126
5,718,659 A * 2/1998 Van Straaten ..... 482/130
5,743,838 A * 4/1998 Willis ..... 482/124
5,772,614 A * 6/1998 Lindquist ..... 601/116
5,865,713 A * 2/1999 Hsu ..... 482/72
5,899,836 A 5/1999 Chen
6,117,056 A * 9/2000 Cataldi et al. ..... 482/121
6,146,316 A * 11/2000 Carolus et al. ..... 482/98
6,159,133 A * 12/2000 Shugg ..... 482/130
6,174,269 B1 * 1/2001 Eschenbach ..... 482/132

(Continued)

OTHER PUBLICATIONS

U.S. Appl. No. 11/354,797, filed Feb. 15, 2006 [unpublished parent application of U.S. Publication No. 2007/0191197, cited above].

*Primary Examiner*—Steve R Crow
*Assistant Examiner*—Robert F Long
(74) *Attorney, Agent, or Firm*—Summa, Additon & Ashe, P.A.

(57) ABSTRACT

The invention relates to a seating device having exercise functionality. In particular, the invention relates to a seating device that can be used as furniture as well as an exercising device. The invention further relates to a seating device having stretchable cords threaded through its framework. Furthermore, the invention relates to a seating device that has brackets attached to its framework to facilitate the movement of the stretchable cords when the seating device is being used for exercise purposes.

19 Claims, 13 Drawing Sheets

U.S. PATENT DOCUMENTS 6,306,067 B1 * 10/2001 Gizas ..... 482/102
6,368,260 B1 * 4/2002 Crews ..... 482/142
6,500,104 B1 * 12/2002 Rich ..... 482/123
6,634,998 B2 * 10/2003 Siaperas ..... 482/142
6,979,284 B2 * 12/2005 Curtis ..... 482/57
7,077,792 B2 * 7/2006 Nerenberg ..... 482/121
7,137,935 B2 * 11/2006 Clarke et al. ..... 482/123
7,226,401 B2 * 6/2007 Van Stratten et al. ..... 482/112
7,322,907 B2 * 1/2008 Bowser ..... 482/121
7,344,484 B1 * 3/2008 Porcellato ..... 482/123
7,357,768 B2 * 4/2008 Marshall ..... 482/148
7,361,127 B2 * 4/2008 Tremayne ..... 482/130
7,488,282 B2 * 2/2009 Leavitt ..... 482/142
2002/0160891 A1 * 10/2002 Gallagher ..... 482/123
2004/0043873 A1 * 3/2004 Wilkinson et al. ..... 482/54
2005/0085356 A1 * 4/2005 Berard ..... 482/126
2005/0187080 A1 8/2005 Bowser
2006/0052224 A1 3/2006 Kellogg
2006/0258520 A1 * 11/2006 Bowser ..... 482/121
2007/0111869 A1 * 5/2007 Wallach ..... 482/129
2007/0191197 A1 8/2007 Vittone et al.
2008/0119333 A1 * 5/2008 Bowser ..... 482/62
2010/0041526 A1 * 2/2010 Bowser et al. ..... 482/123

* cited by examiner

SEATING DEVICE HAVING EXERCISE FUNCTIONALITY

CROSS-REFERENCE TO PRIORITY APPLICATION

This application hereby claims the benefit of provisional patent application Ser. No. 60/807,274, for Seating Device Having Exercise Functionality (filed Jul. 13, 2006), which is hereby incorporated by reference in its entirety.

FIELD OF THE INVENTION

The invention relates to a seating device having exercise functionality.

BACKGROUND OF THE INVENTION

With advancement of science and technology, people are adopting a sedentary lifestyle in which they spend more and more time watching television or sitting in front of personal computers. It is desirable for people to be able to perform exercises while watching television or working on the computer. Indeed, there is a need for exercise equipment that enables a user to perform indoor exercises, particularly when a user is engaged in an otherwise sedentary activity, such as watching television.

Furthermore, many people who live in small homes or apartments do not have space for bulky exercise equipment. It is thus desirable to have exercise equipment that is designed as an attractive piece of furniture.

Exercise equipment is known in the art. U.S. Pat. No. 4,921,247, for instance, discloses an exercise device having a seat, arms, a back, legs, and a space beneath the seat. The chair back has a pair of exercising devices with handles protruding from the back. The handles are extendible from the back when pulled against springs positioned in tubes in the back. The exercise device disclosed in this patent fails to disclose easily detachable bands. In addition, it appears that the exercise functionality of the chair is not completely concealed.

Similarly, U.S. Patent Application Publication No. 2006/005224 discloses a chair adapted to facilitate the performance of various exercises using a resistance cable connected to a handle. The chair disclosed in this publication, however, fails to disclose easily detachable resistance cables. In addition, it appears that the exercise functionality of the chair is not completely concealed.

Therefore, there is a need for an exercise device that possesses aesthetic value and is capable of maintaining its attractiveness by concealing its exercise functionality. In addition, there is a need for an exercise device that possesses easily replaceable parts to thereby limit repair and maintenance costs.

SUMMARY OF THE INVENTION

It is an object of the present invention to provide a comfortable seating device that can be used as a piece of furniture having exercise functionality (e.g., an exercise chair, such as an exercise recliner) yet possess aesthetic value.

It is yet another object of the invention to provide a seating device for performing exercises, yet is capable of concealing its exercise functionality.

It is yet another object of the present invention to provide a seating device that facilitates the performance of more than 70 ergonomically correct exercises.

It is yet another object of the present invention to provide an exercise seating device that can be repaired or retrofitted with minimal cost or effort.

The foregoing, as well as other objectives and advantages of the invention and the manner in which the same are accomplished, are further specified within the following detailed description and supporting figures.

DETAILED DESCRIPTION OF THE INVENTION

The invention embraces seating devices having concealed exercise functionality.

In one aspect, the invention is a seating device that is used as furniture, such as a sofa, chair or, more typically, a recliner. When used as furniture, the exercise functionality of seating device (e.g., an upholstered sofa recliner or an upholstered chair) is concealed to maintain the attractiveness of the furniture.

In another aspect, the invention is an exercise chair that facilitates the performance of various resistance exercises by a user sitting on the chair, or standing or sitting in close proximity to the chair.

The seating device includes at least a seat and an underlying framework. As described herein, hidden brackets are attached to the framework at various locations. The seating device may also include a backrest and dual armrests. Hidden brackets may be attached to the backrest and armrest, too. See FIGS. 1-4.

Figure 3:
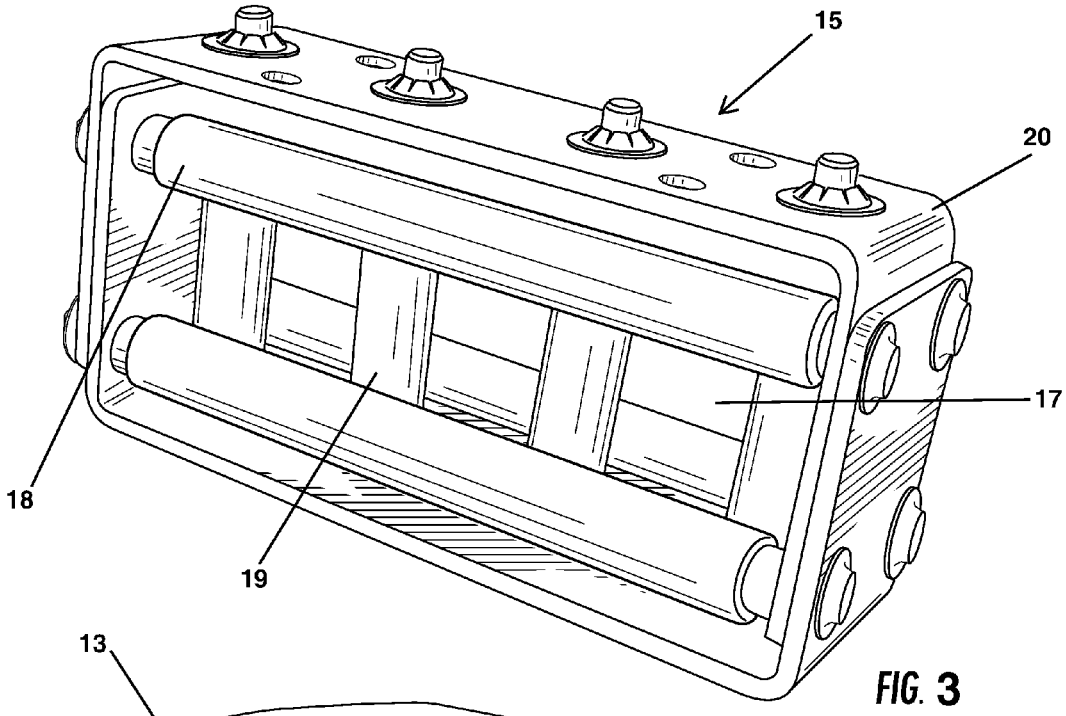
FIG. 3 depicts a bracket with horizontal rollers and vertical rollers that define substantially rectangular reduced-friction slots.
Figure 4:
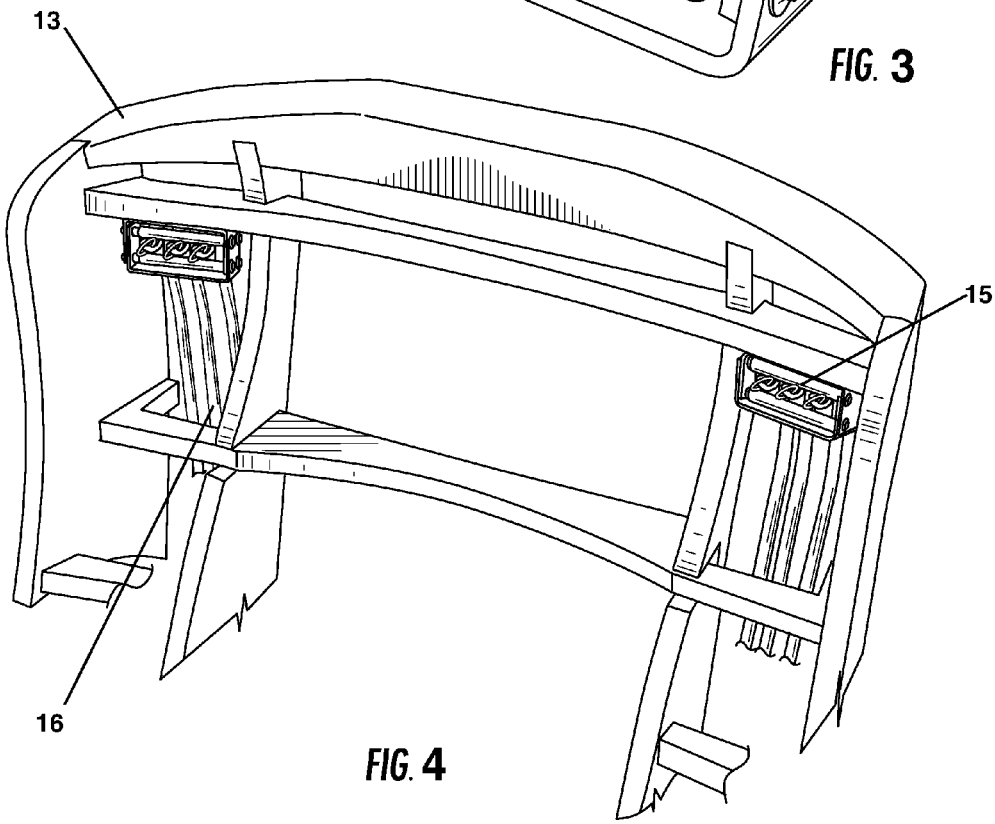
FIG. 4 depicts a portion of the backrest (e.g., a backrest portion of the framework) of the exercise seating device by showing an enlarged view of the stretchable cords and the brackets that are attached to the backrest.

As depicted in FIGS. 3-4, the brackets have openings (e.g., slots) through which stretchable cords (e.g., bands, tubes, and elastics) can be accessed from within the seating device. This design permits a user to perform various resistance exercises. The cords themselves can be made of any stretchy material (e.g., rubber or other polymeric material) possessing sufficient resistance and durability to facilitate strength-building exercises.

In one embodiment, the exercise chair includes a control unit electrically connected to the chair. The control unit assists the user by automatically and correctly positioning the exercise chair, thus enabling the user to perform particular exercises. For instance, a user may direct the control unit to automatically move the chair's backrest such that the backrest is positioned in about the same plane as the chair's seat (i.e., substantially flattened). This supine position facilitates the user's performance of certain abdominal exercises.

In yet another aspect, the invention is a method of using the seating device for performing various exercises. Typically a user performs various resistance exercises by pulling the stretchable cords that are attached to the seating device (e.g., to its framework, its backrest, or its armrest). In particular, a user exposes the brackets (and thus the threaded, stretchable cords), and then pulls the stretchable cords to perform various resistance exercises while either seated on the seating device or positioned near the seating device.

Figure 5:
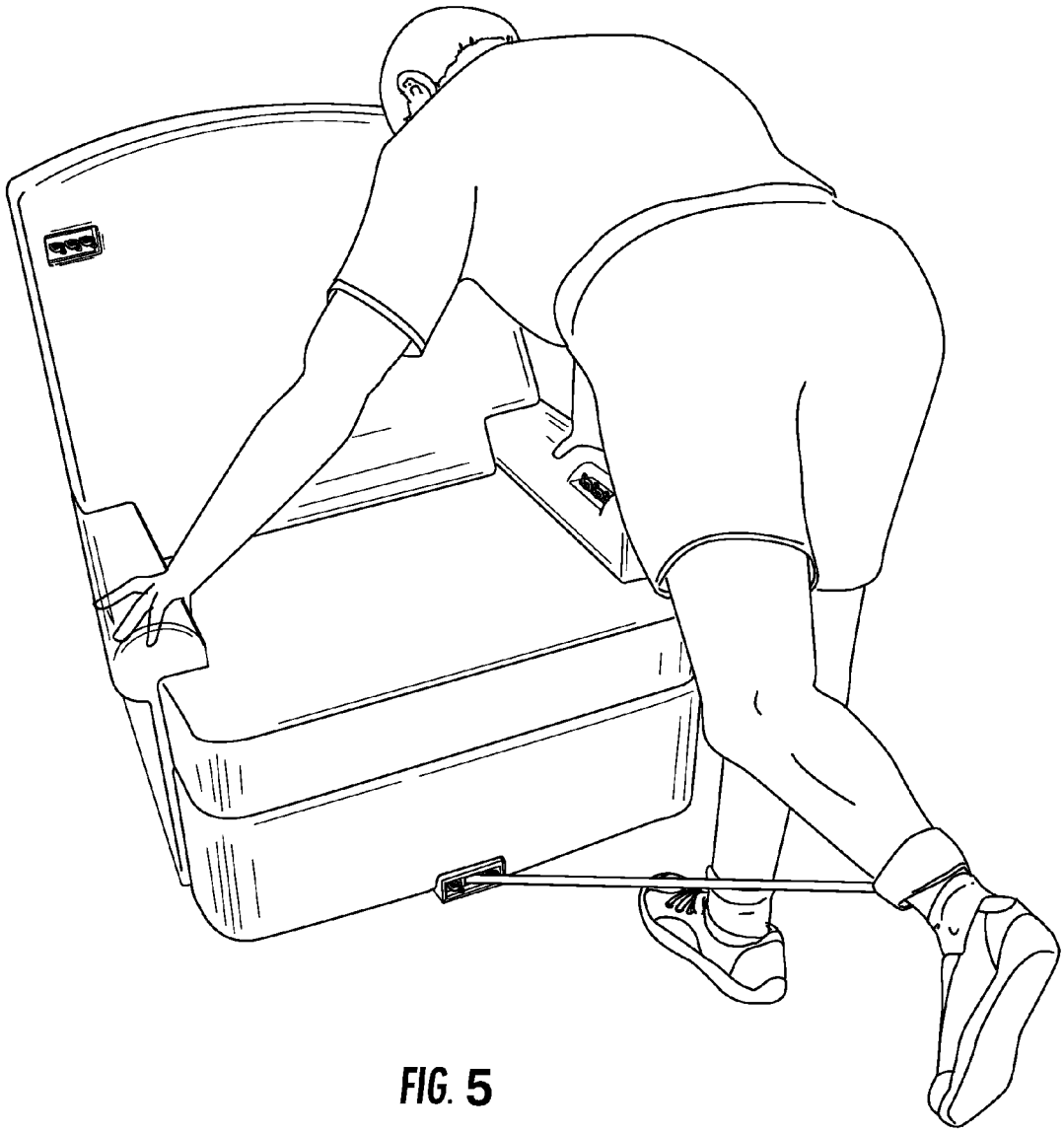
FIGS. 5-8 portrays various uses of an exercise seating device.

For instance, FIG. 5 depicts a person using the seating device to do leg curls. To do this, a user exposes the bracket attached to the base of the seating device (i.e., the underlying framework portion of the seating device) and attaches a leg grip before performing leg curls.

Figure 6:
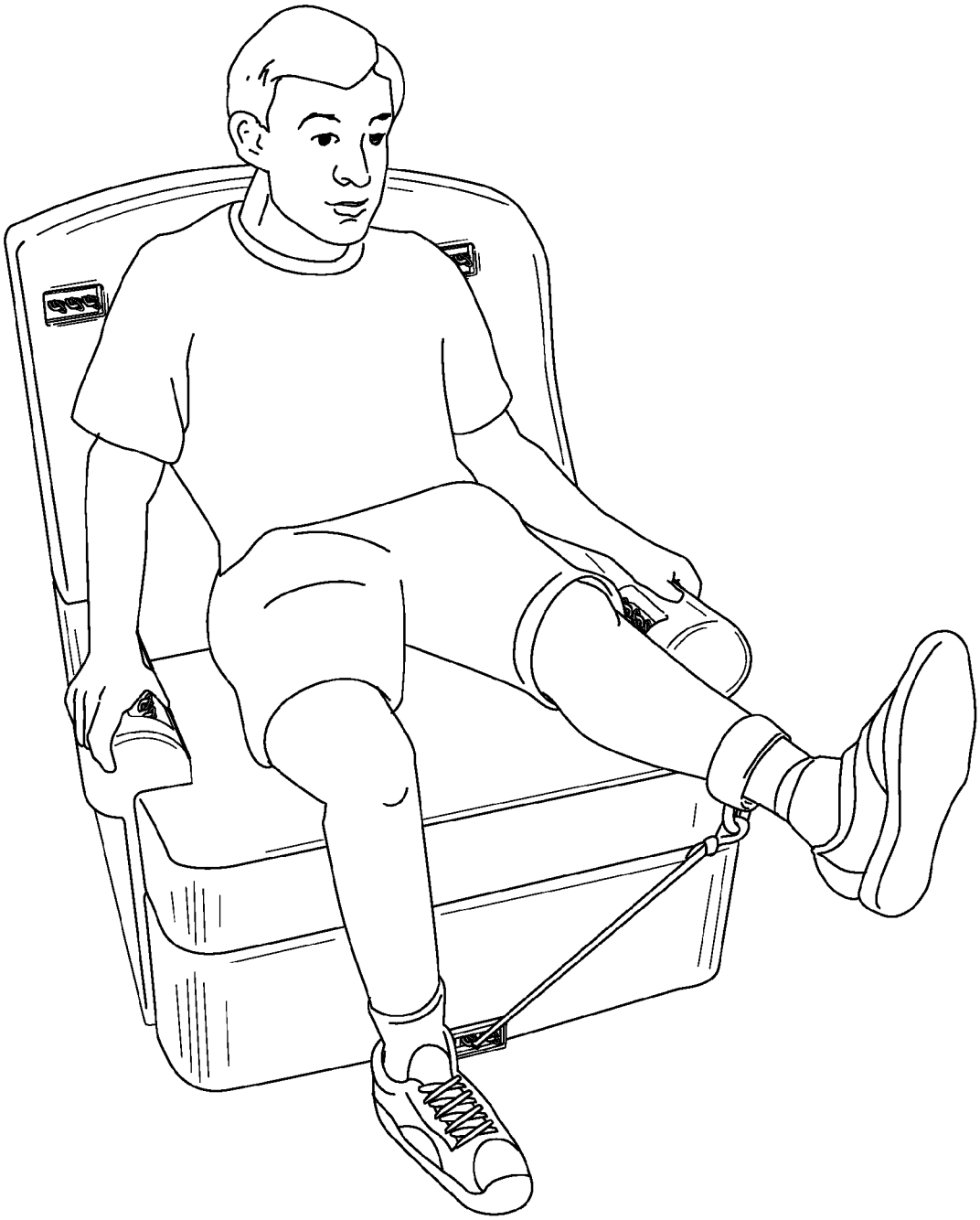
Figure 7:
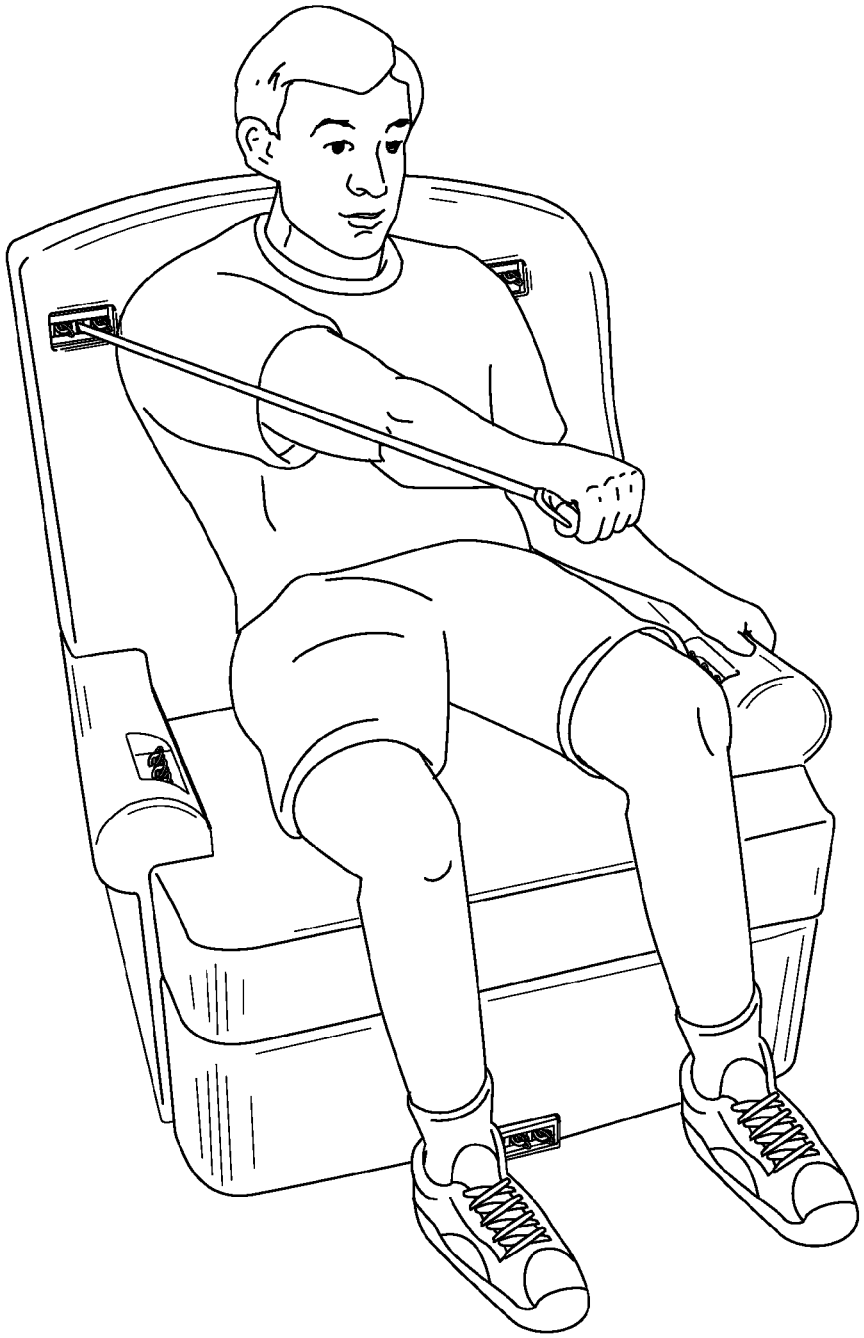
Figure 8:
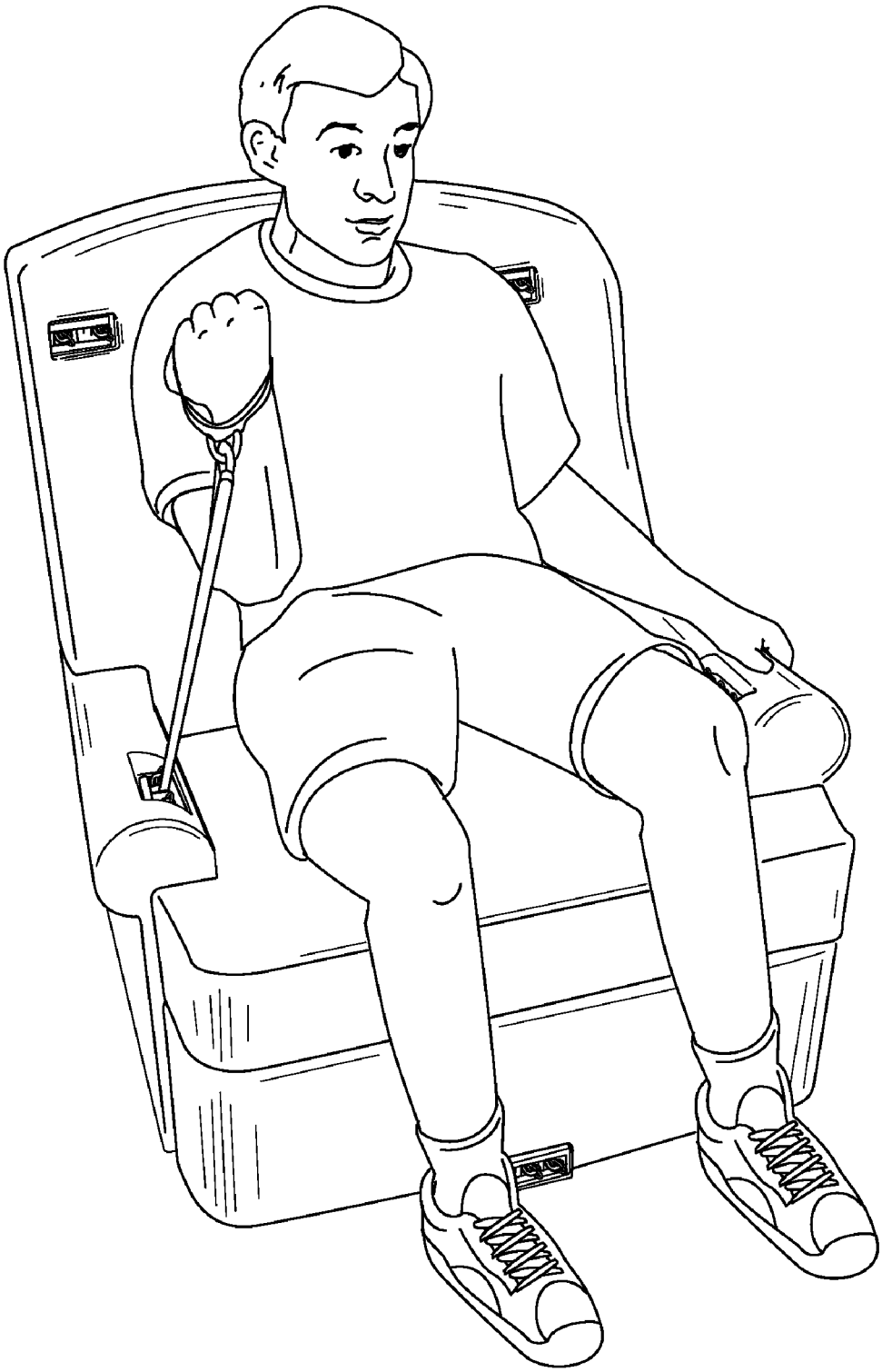

FIGS. 6-8 depict a person using the seating device to do leg extensions, bench presses, and bicep curls, respectively.

The seating device (e.g., an exercise chair) according to the present invention facilitates the performance of numerous kinds of ergonomically correct exercises. Tables 1-5 (below) provide 72 exemplary exercises that may be performed using the seating device as herein disclosed.

Table 1 (below) lists several back exercises that may be performed using the exercise chair of the present invention.

TABLE 1

| BACK EXERCISES | |
|---|---|
| 1 | Seated Lat Row |
| 2 | Standing Lat Row |
| 3 | Lying Lat Pull down |
| 4 | Lying Lat and Fly |
| 5 | Lying Shoulder Pullover |
| 6 | Low Back Extension |

Table 2 (below) lists several aerobic abdominal exercises that may be performed using the exercise chair of the present invention.

TABLE 2

| AEROBIC ABDOMINAL EXERCISES | |
|---|---|
| 7 | Resisted Abdominal Crunch |
| 8 | Seated (Resisted) Oblique Crunch |
| 9 | Abdominal Crunch |
| 10 | Trunk Rotation |
| 11 | Aerobic Rowing |

Table 3 (below) lists several arm exercises that may be performed using the exercise chair of the present invention.

TABLE 3

| ARM EXERCISES | |
|---|---|
| 12 | French Press |
| 13 | Lying Biceps Curl |
| 14 | Seated Wrist Curl |
| 15 | Seated Wrist Extension |
| 16 | Reverse Curl |
| 17 | Lying Triceps Extension |
| 18 | Seated Biceps Curl |
| 19 | Triceps Kickback |
| 20 | Standing Wrist Curl |
| 21 | Barbell Curl |

TABLE 3-continued

| ARM EXERCISES | |
|---|---|
| 22 | Single Arm Pushdown |
| 23 | Lying 45-Degree Triceps Extension |
| 24 | Seated Triceps Press |
| 25 | Cross Triceps Extension |
| 26 | Standing Wrist Extension |

Table 4 (below) lists several leg exercises that may be performed using the exercise chair of the present invention.

TABLE 4

| LEG EXERCISES | |
|---|---|
| 27 | Ankle Eversion |
| 28 | Ankle Inversion |
| 29 | Standing Leg Kickback |
| 30 | Stationary Lunge |
| 31 | Lying Leg Extension |
| 32 | Standing Leg Extension |
| 33 | Leg Extension |
| 34 | Lying (Prone) Leg Curl |
| 35 | Seated Hip Abduction |
| 36 | Standing Hip Abduction |
| 37 | Dead lift |
| 38 | Standing Hip Flexion |
| 39 | Outer Thigh Lift |
| 40 | Inner Thigh Lift |
| 41 | Glute Press |
| 42 | Stationary Lunge |

Table 5 (below) lists several chest exercises that may be performed using the exercise chair of the present invention.

TABLE 5

| CHEST EXERCISES | |
|---|---|
| 43 | Decline Bench Press |
| 44 | Bench Press |
| 45 | Lying Crossover |
| 46 | Chest Fly |
| 47 | Incline Bench Press |
| 48 | Resisted Punch |
| 49 | Front Shoulder Raise |
| 50 | Shoulder Shrug |
| 51 | Shoulder Extension |
| 52 | Rear Delt Row |
| 53 | Standing Lateral Shoulder Raise |
| 54 | Seated Shoulder Press |
| 55 | Lying Shoulder Raise |
| 56 | Scapular Protraction |
| 57 | Scapular Depression |
| 58 | Seated Lateral Shoulder Raise |
| 59 | Shoulder Rotator Cuff External Rotation |
| 60 | Reverse Fly |
| 61 | Shoulder Rotator Cuff Internal Rotation |
| 62 | Wide Shoulder Press |
| 63 | Standing Bicep Curl |
| 64 | Diagonal External Rotation |
| 65 | Front Raise (Anterior Deltoid) |
| 66 | External Rotation |
| 67 | Swimmers Triceps Extensions |
| 68 | Crossover Lateral Raise (Middle Deltoid) |
| 69 | Bent-Over Reverse Fly |
| 70 | Rotational Lift |
| 71 | Lunge Rotation |
| 72 | Swimmers Lat Pull |

As previously noted, the seating device of the present invention is typically formed of a framework, a seat, a backrest, and armrests. The backrest can be attached to the framework and/or to the seat such that the backrest and the seat define substantially non-acute planes (i.e., greater than or equal to about 90°). Likewise, one or both armrests can be attached to the framework and/or to the seat such that the armrest and the seat define substantially non-acute planes (i.e., greater than or equal to about 90°).

The stretchable cords are threaded through a portion of the framework, backrest, and/or armrest of the seating device. Each stretchable cord has a first end that is attached to the seating device (e.g., to its underlying framework) and a second free end. Those having ordinary skill in the art will recognize that at least one end of each cord should be secured to the seating device (e.g., to the framework, to the seat, to the backrest, or to the armrest).

Figure 2:
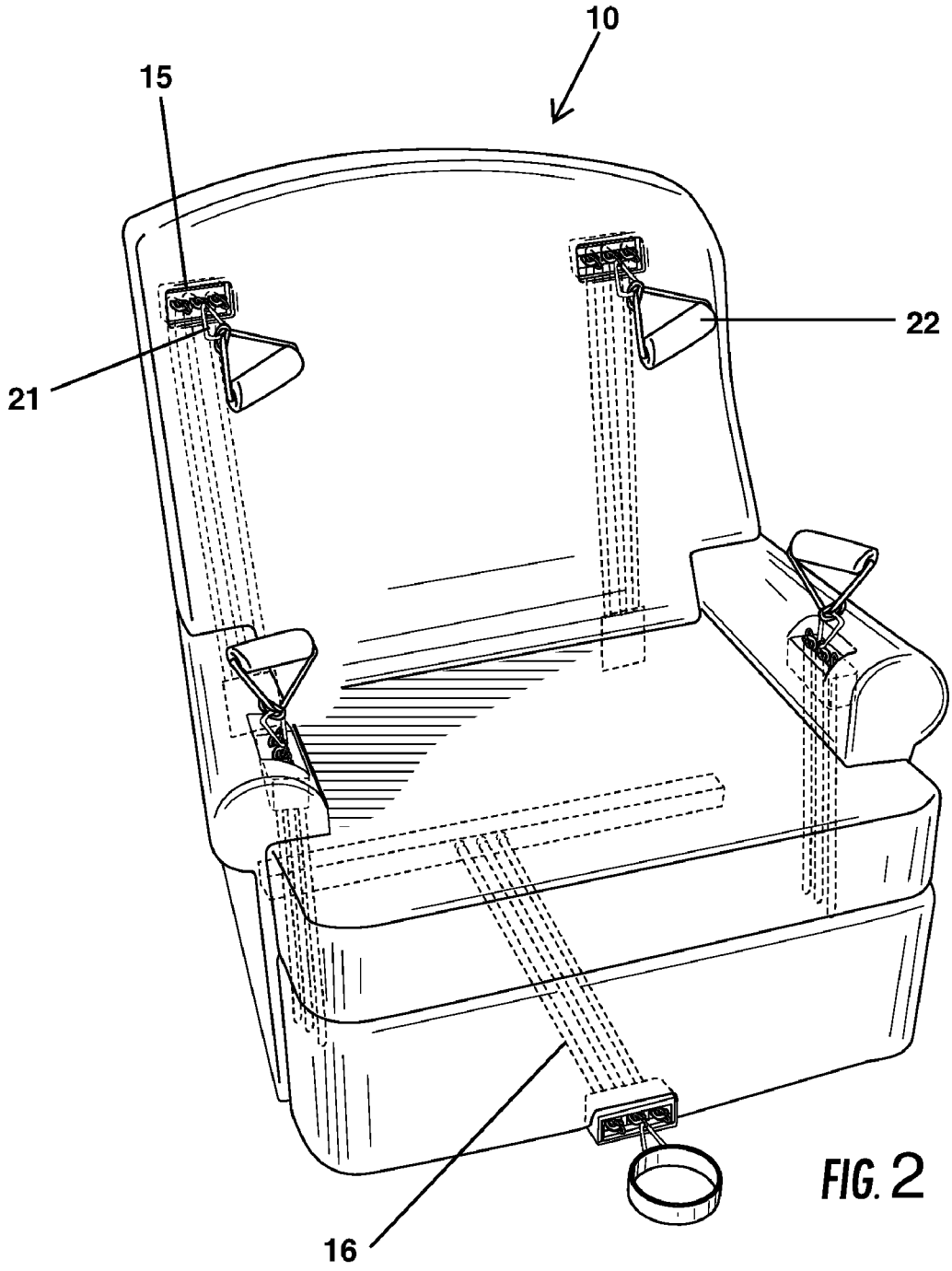
FIG. 2 depicts an exercise seating device with stretchable cords.

As shown in FIGS. 2 and 4, several cords may be threaded through each bracket. Accordingly, the user may access one or more cords for a particular exercise, thereby changing the desired resistance for that exercise. For example, three stretchable cords having nominal resistance of ten pounds each would provide the user with the ability to perform exercises at ten pounds of resistance, 20 pounds of resistance, and 30 pounds of resistance simply by attaching between one and three cords to a grip 22.

Alternatively, three stretchable cords having nominal resistances of five pounds, ten pounds, and 20 pounds, respectively, would provide the user with the ability to perform exercises at five pounds of resistance, ten pounds of resistance, 15 pounds of resistance, 20 pounds of resistance, 25 pounds of resistance, 30 pounds of resistance, and 35 pounds of resistance. Accordingly, in this way the seating device provides tremendous versatility for performing exercises at different levels of resistance.

Typically, each stretchable cord is removably attached to the seating device by a fastener. The stretchable cord is thus capable of being easily replaced by another stretchable cord of the same or different resistance. This kind of simple cord replacement makes the seating device exceptionally versatile. Accordingly, the exercise chair can be used by a wide range of users (e.g., children, young adults, disabled adults, and the elderly) possessing different strengths. Further, if the stretchable cord breaks or loses its elasticity, these same users can easily replace the worn or damaged cord with a new cord at minimal cost and effort.

Those skilled in the art will appreciate that the term "fastener" as used in conjunction with the seating device of the present invention refers to a structure used to connect, couple, or link one or more stretchable cords to grips (e.g., handgrip, ankle grip, or handles), other stretchable cords, and/or the framework of the seating device. The fasteners may include, for example, hooks, anchors, clamps, latches, links, and loops. Typically, the grips 22 or additional stretchable cords are removably attached to the fasteners.

Figure 1:
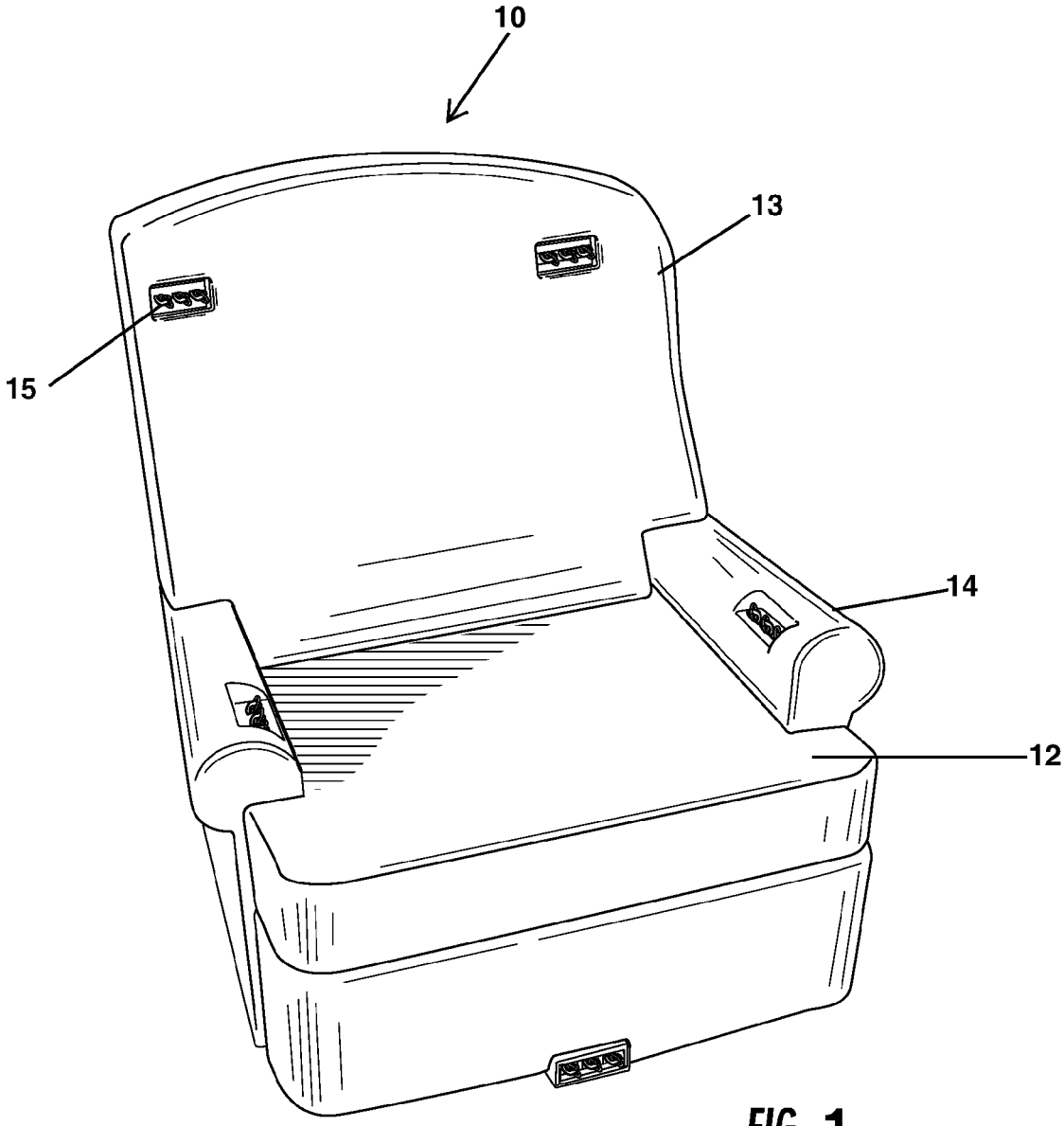
FIG. 1 depicts an exercise seating device (i.e., an exercise chair) with exposed brackets.
Figure 9:
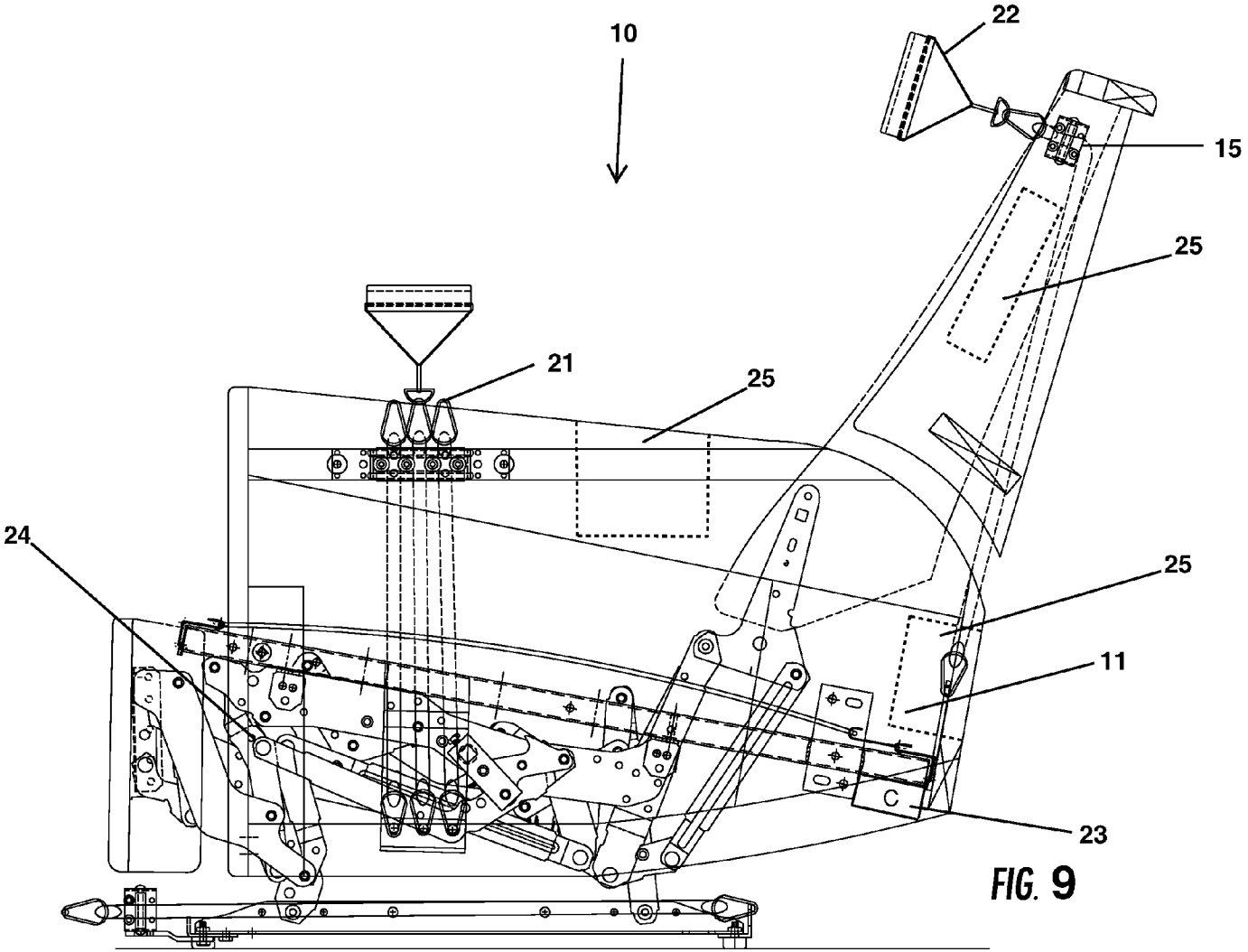
FIG. 9 depicts the detailed structure of an exercise seating device in the form of a chair recliner.
Figure 10:
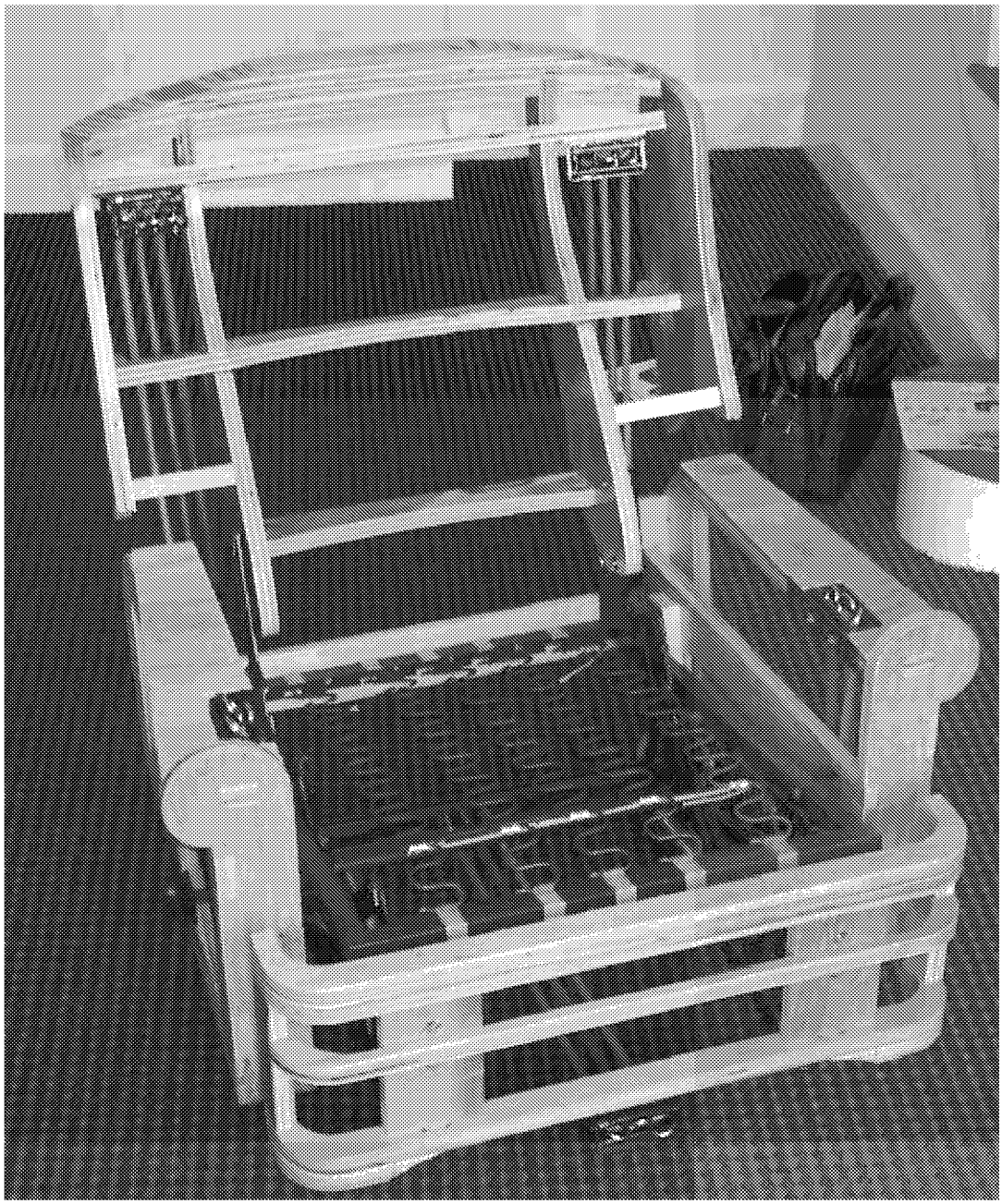
FIGS. 10-11 are photographs illustrating the framework of an exemplary seating device according to the present invention.
Figure 11:
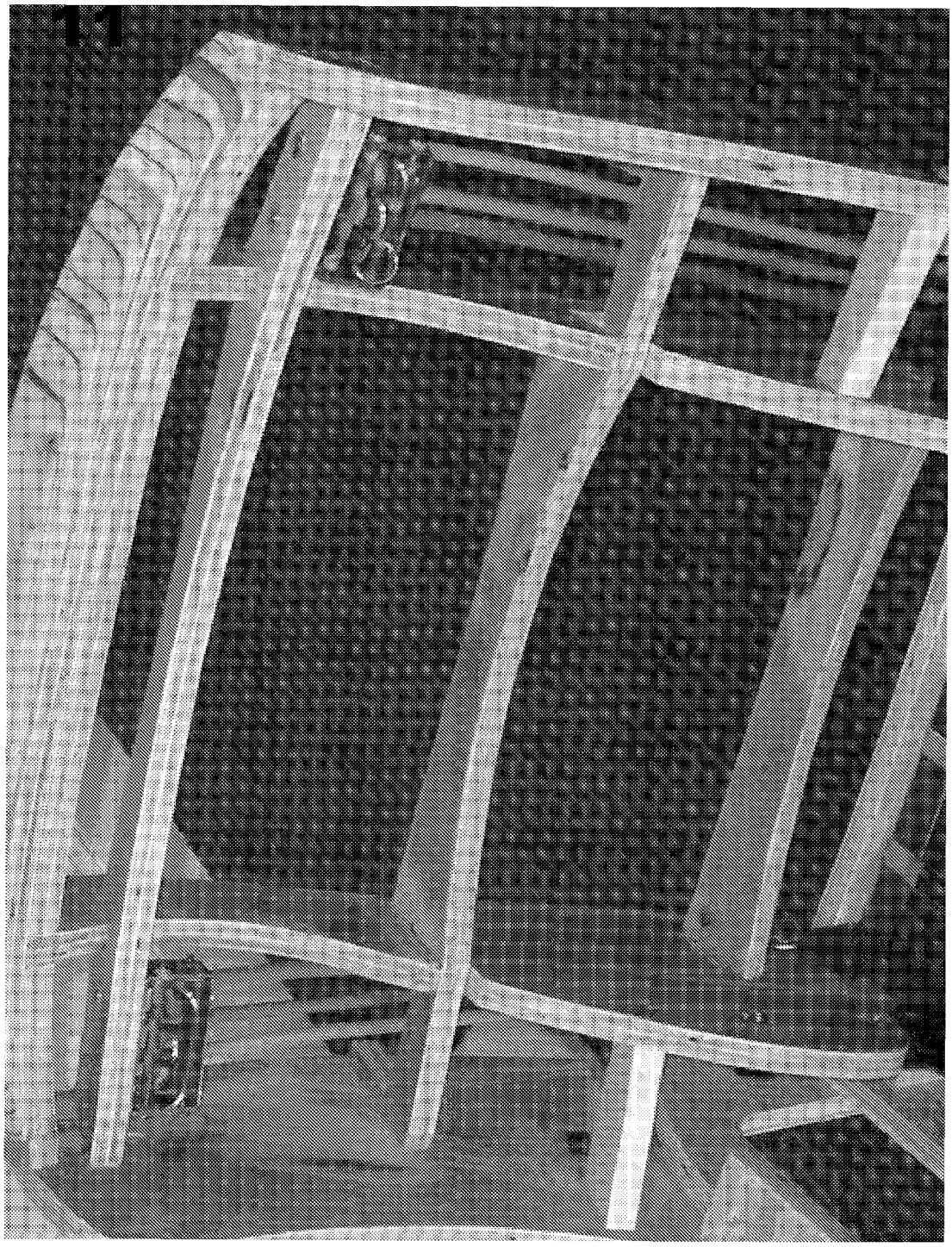

FIG. 1 depicts an exemplary exercise seating device 10, namely a chair recliner having resistance exercise functionality. The seating device 10 includes an underlying framework 11. In this regard, FIGS. 9-11 illustrate the framework of the seating device 10 with stretchable cords 16 threaded through portions of the framework that are accessible for performing various exercises through reduced-friction slots 17 in brackets 15. These figures also show the brackets 15 secured to the framework. FIG. 9, for example, depicts a control unit 23 for positioning the exercise seating device 10 between an upright and a supine position (e.g., via a reclining mechanism 24).

In one embodiment of the seating device 10 according to the present invention, the framework 11, which provides a skeletal base for the seating device 10, may be made up of one or more rigid materials (e.g., wood, metal, a polymeric material, or a combination thereof).

FIG. 1 further depicts a seat 12 positioned on the framework 11. A backrest 13 and armrests 14 complete the basic structure of the seating device 10. The backrest 13 and the armrests 14 can be attached, for example, to the framework 11, to the seat 12, or to both the framework 11 and the seat 12.

Figure 12:
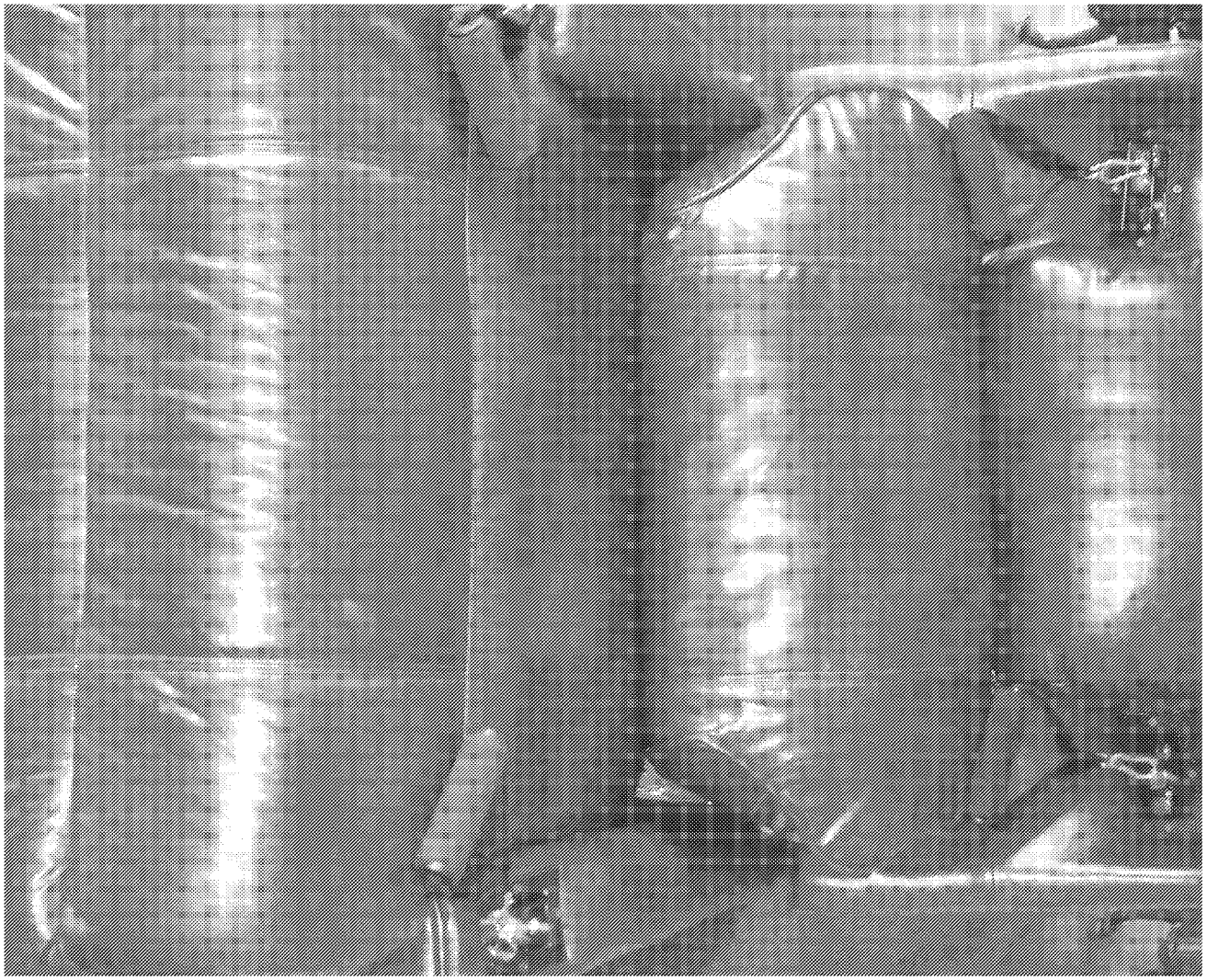
FIG. 12 is a photograph illustrating the exposed exercise functionality in an exemplary embodiment of the seating device.

FIG. 1 further depicts exposed brackets 15 attached to the framework 11, backrest 13, and armrest 14 of the seating device 10. In addition, FIG. 12 illustrates exposed brackets 15 with grips 22 attached to the seating device 10 for performing various exercises.

FIG. 3 depicts an enlarged view of an exemplary bracket 15 that is attached to the framework 11, the backrest 13, and/or the armrest 14. As shown in FIG. 3, the bracket 15 includes two rows of horizontal rollers 18 and one row of vertical rollers 19. Horizontal and vertical rollers 18 and 19, respectively, are rotatably positioned within a housing 20. The rows of horizontal rollers 18 and vertical rollers 19 thus define respective horizontal and vertical gaps.

For instance, as depicted in FIG. 3, a bottom horizontal roller 18 and a top horizontal roller 18, which are typically parallel to each other, define a first horizontal roller pair (e.g., a substantially coplanar set of horizontal rollers). Likewise, by way of example and as depicted in FIG. 3, any two adjacent vertical rollers 19, which are typically parallel to each other, can define a vertical roller pair (e.g., a coplanar set of vertical rollers).

To better secure the bracket 15 to the seating device 10 and improve the appearance of the seating device 10, a flange may be attached to a bracket 15. FIG. 12 shows an exemplary rectangular flange that helps secure a bracket 15 to the seating device 10.

Typically, the housing 20 of a bracket 15 has at least three rows of rollers in which either (i) a row of vertical rollers 19 is positioned between two rows of horizontal rollers 18 (as shown in FIG. 3) or (ii) a row of horizontal rollers 18 is positioned between two rows of vertical rollers 19. These alternate rows of horizontal 18 and vertical rollers 19 thus define slots 17, which are typically rectangular. In other words, it is the combination of one or more horizontal gaps and one or more vertical gaps that form a slot 17 (e.g., a reduced-friction slot).

Those having ordinary skill in the art will appreciate that it is within the scope of the present invention for any row of horizontal rollers 18 (or any row of vertical rollers 19) to include more than two rollers.

In addition to the roller-based reduced-friction slot, other bracket 15 designs are within the scope of the invention. For instance, one or more reduced-friction openings may also be formed in a bracket 15 by including rotatable metal balls (e.g., ball bearings and/or roller bearings).

Typically, stretchable cords 16 are threaded through a portion of the framework 11, backrest 13 (e.g., a backrest portion of the framework) and/or armrest 14 (e.g., an armrest portion of the framework), such that the first end of each stretchable cord is attached to the framework 11. The second free end of the stretchable cord runs through a slot 17 in the bracket 15. See FIG. 2. The horizontal and vertical rollers 18-19 of the bracket 15 are capable of rotating 360°, thereby minimizing friction between the cord 16 and the bracket 15 that would otherwise result during exercise. See FIGS. 3 & 4.

In one embodiment of the seating device 10, the second end of the stretchable cord 16 may be removably connected to fasteners 21. Through these fasteners 21, the stretchable cord 16 may be removably connected either to a grip 22 (see FIG. 2) or to additional stretchable cords 16.

Alternatively, the stretchable cord 16 may be secured to another part of the seating device 10. In other words, both ends of the stretchable cord 16 are secured to the seating device 10. This facilitates two-handed exercises in which the user grasps the center section of the stretchable cord 16, thereby gaining resistance from both ends of the cord 16.

The seating device 10 of the present invention may also include storage areas 25 to secure exercise equipment and other accessories, such as grips 22, fasteners 21, and additional stretchable cords 16. These storage areas 25 can be in the form of spaces in the framework 11, the backrest 13, the armrest 14, or in the upholstery of the seating device 10. Alternatively, the storage areas 25 can be pockets or pouches.

Figure 13:
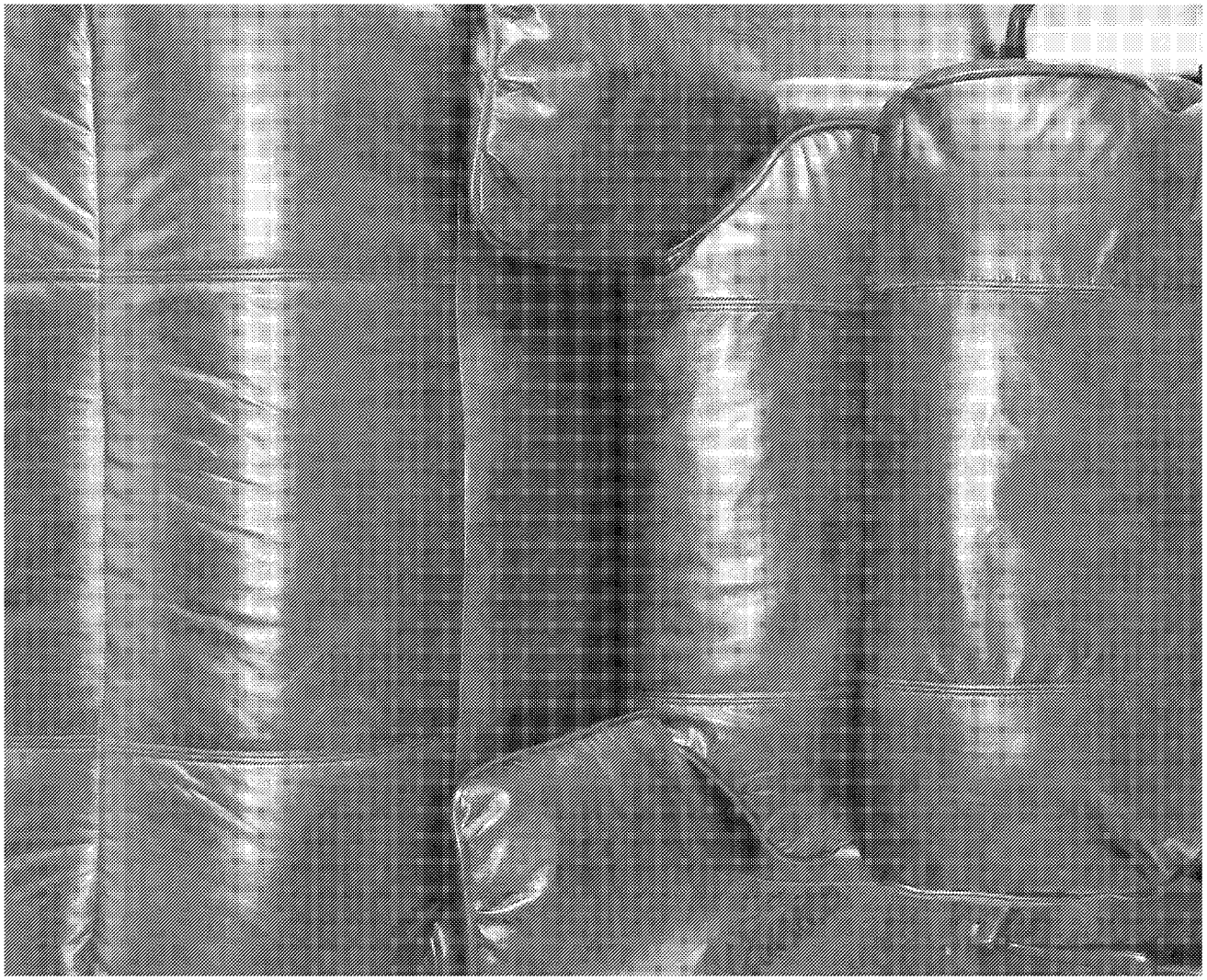
FIGS. 13-14 are photographs illustrating the concealed exercise functionality in an exemplary seating device (i.e., a recliner) according to the present invention.
Figure 14:
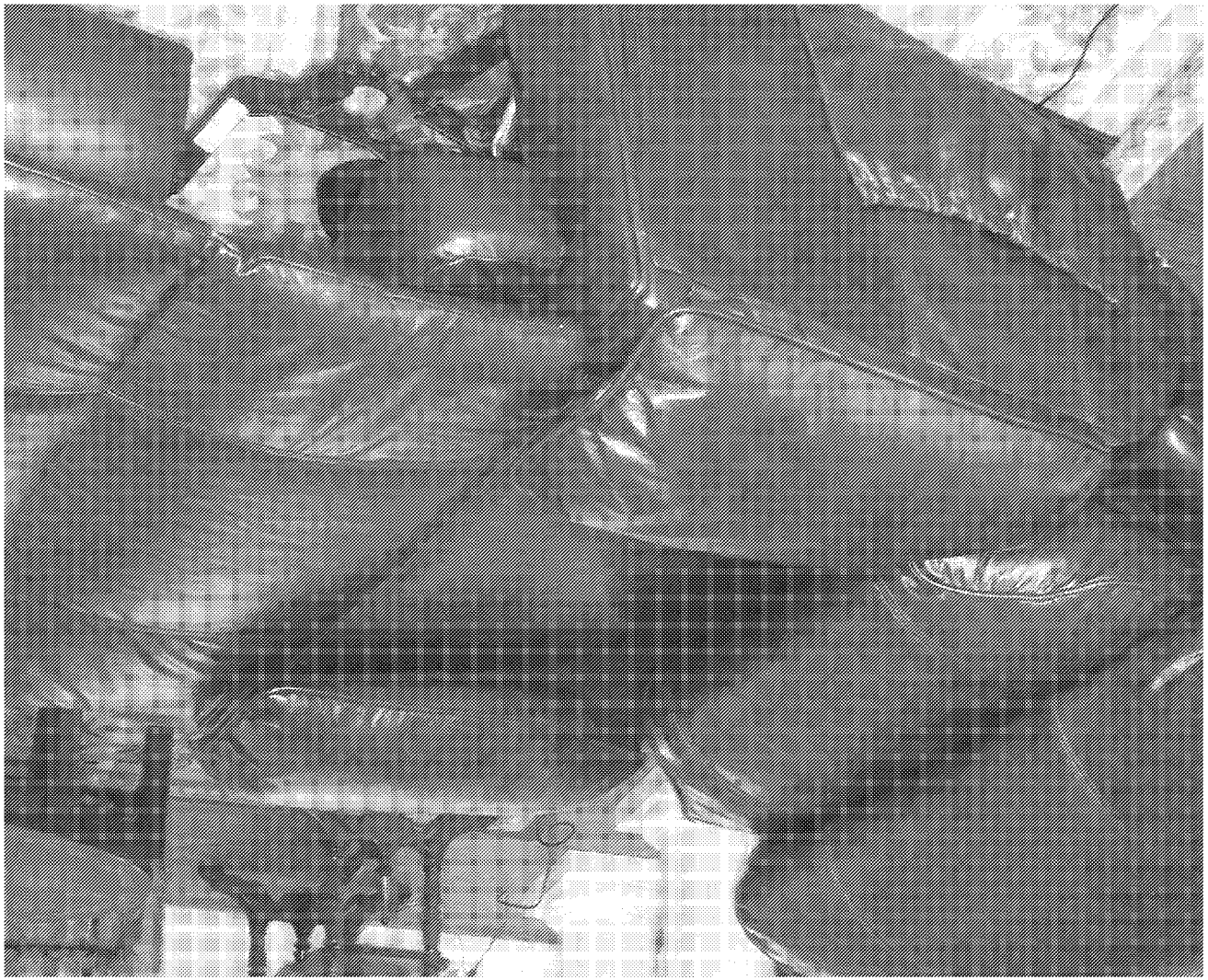

When the seating device 10 is being used as furniture, such as an upholstered chair or an upholstered sofa recliner (e.g., padded and covered with fabric or leather), the brackets 15 are hidden by upholstery and/or cushions. Thus, the exercise functionality of the seating device 10 is not apparent, and thus the seating device 10 may be used as attractive furniture in living areas. FIGS. 13-14 show the aesthetic value of the seating device 10 with concealed exercise functionality.

In the specification and drawings, typical embodiments of the invention have been disclosed and, although specific terms have been employed, they have been used in a generic and descriptive sense only and not for purposes of limitation.

The invention claimed is:

1. A seating device, comprising:

a seat;

a framework comprising a base portion, a backrest portion, and an armrest portion, said framework supporting said seat;

at least one reduced-friction bracket secured to said backrest portion of said framework and/or at least one reduced-friction bracket secured to said armrest portion of said framework, at least one said reduced-friction bracket comprising:

a housing having a top wall, a bottom wall, and sidewalls to thereby define an open interior;

a bottom horizontal roller and a top horizontal roller rotatably connected to said housing sidewalls, said bottom and top horizontal rollers positioned (i) apart from one another and (ii) defining a first gap between said housing sidewalls; and a first vertical roller, a second vertical roller, and a third vertical roller rotatably connected to said housing bottom wall and said housing top wall, said first, second, and third vertical rollers positioned apart from one another, said first and second vertical rollers defining a second gap between said housing bottom wall and said housing top wall, and said second and third vertical rollers defining a third gap between said housing bottom wall and said housing top wall;

wherein said first and second gaps together define a first reduced-friction slot, and said first and third gaps together define a second reduced-friction slot;

wherein said bottom horizontal and top horizontal rollers are positioned substantially parallel to each other, and said first, second, and third vertical rollers are positioned substantially parallel to each other;

wherein said bottom horizontal roller and said top horizontal roller define a first plane, and wherein said first, second, and third vertical rollers define a second plane that is distinct from said first plane; and a plurality of stretchable cords removably secured to said framework;

wherein each said stretchable cord has a first end connected to said framework and a second free end threaded through a reduced-friction slot in said reduced-friction bracket;

wherein each said reduced-friction slot has no more than one stretchable cord threaded therethrough.

2. A seating device according to claim 1, wherein:

said bottom horizontal roller and said top horizontal roller define a first horizontal roller pair; and said bracket further comprises at least one additional horizontal roller pair.

3. A seating device according to claim 1, said reduced-friction bracket further comprising:

a second bottom horizontal roller and a second top horizontal roller rotatably connected to said housing sidewalls, said second bottom horizontal roller and said second top horizontal roller positioned (i) apart from one another and (ii) defining a fourth gap between said housing sidewalls;

wherein, relative to said first, second, and third vertical rollers, said bottom horizontal roller and said top horizontal roller are positioned on one side of said housing and said second bottom horizontal roller and said second top horizontal roller are positioned on the other side of said housing.

4. A seating device according to claim 1, wherein the first end of one of said stretchable cords is removably connected to said framework.

5. A seating device according to claim 1, further comprising a fastener removably connected to the first end of one of said stretchable cords.

6. A seating device according to claim 1, further comprising a fastener connected to the second end of one of said stretchable cords.

7. A seating device according to claim 1, wherein at least two of said stretchable cords possess different resistances.

8. A seating device according to claim 1, wherein one or more of said stretchable cords are threaded within said backrest portion of said framework.

9. A seating device according to claim 1, wherein one or more of said stretchable cords are threaded within said armrest portion of said framework.

10. A seating device according to claim 1, wherein one or more of said stretchable cords are threaded within a portion of said framework such that one or more of said stretchable cords run from the back of the seating device toward the front of the seating device.

11. A seating device according to claim 2, wherein said at least one additional horizontal roller pair is positioned in a different plane from the plane defined by said first horizontal roller pair.

12. A seating device according to claim 6, further comprising a grip removably connected to said fastener.

13. A seating device according to claim 6, wherein said fastener is removably connected to the second end of one of said stretchable cords.

14. A seating device according to claim 6, wherein said fastener is removably connected to at least two of said stretchable cords.

15. A seating device comprising:

a seat;

a framework comprising a base portion, a backrest portion, and an armrest portion, said framework supporting said seat;

at least one reduced-friction bracket secured to said backrest portion of said framework and/or at least one reduced-friction bracket secured to said armrest portion of said framework, at least one said reduced-friction bracket comprising:

a housing having a top wall, a bottom wall, and sidewalls to thereby define an open interior;

a bottom horizontal roller and a top horizontal roller rotatably connected to said housing sidewalls, said bottom and top horizontal rollers positioned (i) apart from one another and (ii) defining a first gap between said housing sidewalls;

a first vertical roller, a second vertical roller, and a third vertical roller rotatably connected to said housing bottom wall and said housing top wall, said first, second, and third vertical rollers positioned apart from one another, said first and second vertical rollers defining a second gap between said housing bottom wall and said housing top wall, and said second and third vertical rollers defining a third gap between said housing bottom wall and said housing top wall; and a fourth vertical roller rotatably connected to said housing bottom wall and said housing top wall, said fourth vertical roller positioned apart from said first, second, and third vertical rollers, said third and fourth vertical rollers defining a fourth gap between said housing bottom wall and said housing top wall;

wherein said first and second gaps together define a first reduced-friction slot, and said first and third gaps together define a second reduced-friction slot;

wherein said first and fourth gaps together define a third reduced-friction slot;

wherein said bottom horizontal and top horizontal rollers are positioned substantially parallel to each other, and said first, second, and third vertical rollers are positioned substantially parallel to each other; and a plurality of stretchable cords removably secured to said framework;

wherein each said stretchable cord has a first end connected to said framework and a second free end threaded through a reduced-friction slot in said reduced-friction bracket;

wherein each said reduced-friction slot has no more than one stretchable cord threaded therethrough.

16. A seating device, comprising:

a seat;

a framework comprising a base portion, a backrest portion, and an armrest portion, said framework supporting said seat;

at least one reduced-friction bracket secured to said backrest portion of said framework and/or at least one reduced-friction bracket secured to said armrest portion of said framework, at least one said reduced-friction bracket comprising:

a housing having a top wall, a bottom wall, and sidewalls to thereby define an open interior;

a bottom horizontal roller and a top horizontal roller rotatably connected to said housing sidewalls, said bottom and top horizontal rollers positioned (i) apart from one another and (ii) defining a first gap between said housing sidewalls; and a first vertical roller, a second vertical roller, and a third vertical roller rotatably connected to said housing bottom wall and said housing top wall, said first, second, and third vertical rollers positioned apart from one another, said first and second vertical rollers defining a second gap between said housing bottom wall and said housing top wall, and said second and third vertical rollers defining a third gap between said housing bottom wall and said housing top wall;

wherein said bottom horizontal roller and said top horizontal roller define a first plane, and said first, second, and third vertical rollers define a second plane that is distinct from said first plane, and wherein said first and second planes are substantially parallel;

wherein said first and second gaps together define a first reduced-friction slot, and said first and third gaps together define a second reduced-friction slot; and a plurality of stretchable cords removably secured to said framework;

wherein each said stretchable cord has a first end connected to said framework and a second free end threaded through a reduced-friction slot in said reduced-friction bracket;

wherein each said reduced-friction slot has no more than one stretchable cord threaded therethrough.

17. A seating device according to claim 16, comprising:

a second bottom horizontal roller and a second top horizontal roller rotatably connected to said housing sidewalls, said second bottom and second top horizontal rollers positioned (i) apart from one another and (ii) defining a fourth gap between said housing sidewalls;

wherein said second bottom horizontal roller and said second top horizontal roller define a third plane that is distinct from said first and second planes, said second plane being positioned between said first and third planes.

18. A seating device according to claim 17, wherein said first, second, and third planes are substantially parallel.

19. A seating device according to claim 17, wherein said first reduced-friction slot and said second reduced-friction slot are further defined by said fourth gap.

* * * * *

UNITED STATES PATENT AND TRADEMARK OFFICE

CERTIFICATE OF CORRECTION

PATENT NO. : 7,803,094 B1
APPLICATION NO. : 11/777605
DATED : September 28, 2010
INVENTOR(S) : Charles H. Bolick, Jr., C. David Bolick and Timothy Ray Bolick It is certified that error appears in the above-identified patent and that said Letters Patent is hereby corrected as shown below:

In the Title Page

Item (73) reads: Assignee: Charles H. Bolick, Conover, ~~CT~~ (US)

and should read item [73]: Assignee: Charles H. Bolick, Conover, NC (US)

Signed and Sealed this

Seventh Day of December, 2010

David J. Kappos

David J. Kappos
*Director of the United States Patent and Trademark Office*